US005797342A

United States Patent [19]

Ferreira et al.

[11] Patent Number: 5,797,342

[45] Date of Patent: Aug. 25, 1998

[54] SUBMERSIBLE DEVICE LAUNCHER

[75] Inventors: Delfino D. Ferreira, Middletown; Nicholas O. Venier, Tiverton, both of R.I.

[73] Assignee: The United States of America as represented by the Secretary of the Navy, Washington, D.C.

[21] Appl. No.: 891,370

[22] Filed: Jul. 10, 1997

[51] Int. Cl.[6] ..... B63B 1/00

[52] U.S. Cl. ..... 114/239

[58] Field of Search ..... 114/312, 238, 114/239

[56] References Cited

U.S. PATENT DOCUMENTS

| | | | |
|---|---|---|---|
| 713,985 | 11/1902 | Hoyos | 114/239 |
| 3,516,380 | 6/1970 | Johnston | 114/238 |
| 3,890,919 | 6/1975 | Opdahl et al. | 114/239 |

*Primary Examiner*—Stephen Avila

*Attorney, Agent, or Firm*—Micahel J. McGowan; James M. Kasischke; Prithvi C. Lall

[57] ABSTRACT

A submersible device launcher includes an external cage structure including at least a base, an overhead reinforcing member and a plurality of corner posts connecting the base to the overhead reinforcing member. A launcher barrel is mounted to the external cage structure, a half-wall is mounted to and braced against the base of the external cage structure at a peripheral edge thereof, and an impulse cylinder is mounted to the half wall for connection to the launcher barrel. A firing valve is anchored to the base of the external cage structure, a first support bench is mounted to a first corner post of the external cage structure, and an air flask is seated on the first support bench and held in a stationary position thereon by prong members extending upwardly from the first support bench and further attached to a corner post by a band member. An underwater junction box is mounted to another corner post of the external cage structure, and a display panel is remotely positioned above the water surface for operating the firing valve and monitoring depth pressure firing valve pressure, air flask pressure and impulse cylinder at-battery and firing positions.

9 Claims, 4 Drawing Sheets

SUBMERSIBLE DEVICE LAUNCHER

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

This invention generally relates to a submersible device launcher and more specifically to an apparatus for housing a submersible device launcher such that the submersible device launcher may be test launched without the use of a submarine.

(2) Description of the Prior Art

The U.S. Navy currently uses a three-inch device delivery system within a submarine to launch three-inch countermeasure devices, pyrotechnic and communication devices, and bathythermograph probes. Currently, it is not feasible to perform functional and reliability tests on new or improved 'live' pyrotechnic devices in a laboratory facility for the three-inch device launcher due to the explosive nature of the markers and flares utilized therein. It is therefore desirable to test launch from a three-inch delivery system without having the expense of deploying a submarine for that purpose. Heretofore, there have been no suitable solutions to this problem in the art.

Known structures for the testing of various launching devices include the following:

U.S. Pat. No. 3,062,047 to Armi et al. discloses an apparatus for the determination of interior ballistics. Although the ballistic testing equipment is mounted on a platform, the device is not submersible.

U.S. Pat. No. 3,075,301 to Feidler et al., discloses a launch and underwater trajectory test vehicle which is launched from an underwater launching device. The underwater launching device may take the form of a mobile or stationary device, however any further description thereof is not provided.

U.S. Pat. No. 3,693,432 to Stewart et al. discloses an artillery gun shock simulator. There is no teaching or suggestion, however, of mounting the simulator underwater to achieve a submersible test device.

U.S. Pat. No. 4,776,277 to Fiedler et al. discloses a method and arrangement for implementing an operational test on electrically-actuatable ignition circuits for ammunition. The apparatus includes a supply apparatus, control apparatus and measuring apparatus all resting on the ground with no additional particular support structure shown. Further, the device is not disclosed as being of a submersible nature, particularly absent any support structure for accomplishing cohesive submersion.

SUMMARY OF THE INVENTION

Therefore it is an object of this invention to provide a dedicated submersible launcher to perform functional and reliability tests on various commonly launched devices.

Another object of the invention is to provide a submersible platform upon which a device launcher may be mounted to perform functional and reliability tests on various 'live' pyrotechnic devices.

Still yet another object of the invention is to provide a submersible platform which is portable between various locations and includes launcher mounting and support members for that purpose.

In accordance with one aspect of this invention, a submersible device launcher includes an external cage structure having at least a base, an overhead reinforcing member and a plurality of corner posts connecting the base to the overhead reinforcing member. A launcher barrel is mounted to a side wall of the external cage structure adjacent the overhead reinforcing member and extends towards the interior of the external cage structure. A half-wall is mounted to and braced against the base of the external cage structure at a peripheral edge thereof, and an impulse cylinder is mounted to the half wall and connected by piping to the launcher barrel.

A firing valve is anchored to the base of the external cage structure at a peripheral edge thereof and in proximity to the impulse cylinder. A first support bench is mounted to a first corner post of the external cage structure at a position above the base, and an air flask is seated on the first support bench and held in a stationary position thereon by prong members extending upwardly from the first support bench conformally around a base of the air flask and further attached to the first corner post by a band member.

An underwater junction box is mounted to a second corner post of the external cage structure at a position above the base, and a display panel is remotely positioned above the water surface and connected to the underwater junction box by a cable to operate the firing valve and to monitor depth pressure, firing valve pressure, air flask pressure and impulse cylinder at battery and fired positions.

Additionally, each of the launcher barrel, impulse cylinder, firing valve, air flask, and underwater junction box are positioned within the external cage structure such that upon submersion thereof an evenly balanced arrangement is present.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF THE PREFERRED EMBODIMENT

Figure 1:
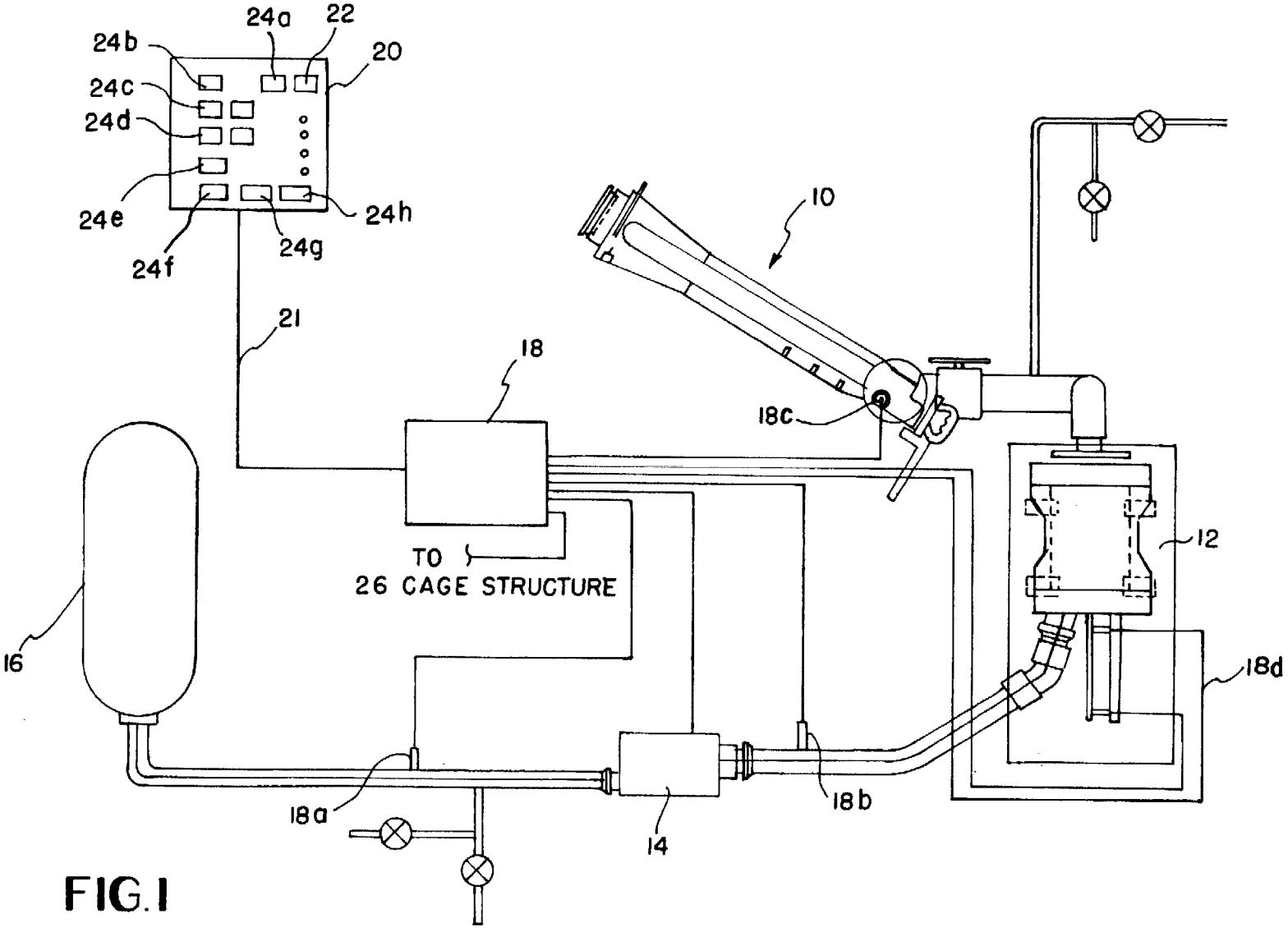
FIG. 1 is a diagram partially in schematic showing conventional elements of a submarine signal launcher.

FIG. 1 depicts a partially schematic diagram showing details of a submarine signal launcher.

The submersible device launcher shown in FIG. 1 includes of a three-inch launcher barrel 10, impulse cylinder 12, firing valve 14, air flask 16, underwater junction box 18, and display panel 20.

The three-inch launcher barrel 10 is a standard U.S. submarine fleet barrel with all of the standard clearances, guide slot, trip bolt, detent, shear valve, and breech door with locking ring. These features are not specifically shown as they are not critical to an understanding of the invention. The three-inch devices are loaded in the barrel 10 in the same manner as on board the submarine.

The impulse cylinder 12 is a standard U.S. submarine impulse cylinder. The impulse cylinder 12 is connected to and provides the hydrodynamic force necessary for ejecting the device from the launcher barrel 10.

The firing valve 14 is connected between the impulse cylinder 12 and the air flask 16 and includes a special submersible valve that provides air pressure to an air side of a piston of the launcher impulse cylinder 12 for launching the devices from the launcher barrel 10.

The air flask 16 provides the required air pressure and volume to the impulse cylinder 12 via the firing valve 14 to eject the device from the launcher barrel 10.

The underwater junction box 18 is the interface link to monitor various signals in the launcher system and is appropriately connected to each of the three-inch launcher barrel 10, the impulse cylinder 12, the air flask 16, the firing valve 14, and the cage structure 26.

The underwater junction box 18 is connected to a pressure sensor 18*a* positioned between air flask 16 and firing valve 14. It is connected to a second pressure sensor 18*b* positioned between firing valve 14 and impulse cylinder 12. Junction box 18 is also connected to firing valve 14 to provide a launch signal, and to impulse cylinder 12 to monitor whether the impulse cylinder 12 is in the at-battery position or the fired position. The junction box is further connected at 18*c* to the three-inch launcher barrel 10 to give a device away indication signal. Another connection 18*d* is attached to a cage structure 26 to provide a ground.

The display panel 20 is positioned at the surface of the water for dry use and is attached to the underwater junction box 18 by means of a cable 21. The display panel 20 includes a launch button 22 to launch the device as well as various displays 24*a*, 24*b*, 24*c*, 24*d*, 24*e*, 24*f*, 24*g*, and 24*h* to monitor and control conditions on the submersible launcher. These various displays of the submersible launcher will include a launch enable viewing screen 24*a*, a launch button 22, display panel power 24*b*, ram atbattery/fired conditions 24*c*, device present/away indications 24*d*, velocity display 24*e*, flask pressure 24*f*, depth gage 24*g*, and firing valve pressure 24*h*. These various elements are known to be required for monitoring and controlling a launch device and therefore, will not be further explained herein for the sake of brevity.

The submersible three-inch device launcher barrel 10 is capable of launching devices at the maximum required barrel exit velocity. The launcher barrel 10 fires the devices by means of an electrical signal initiated at the display panel 20 at the surface.

Figure 2:
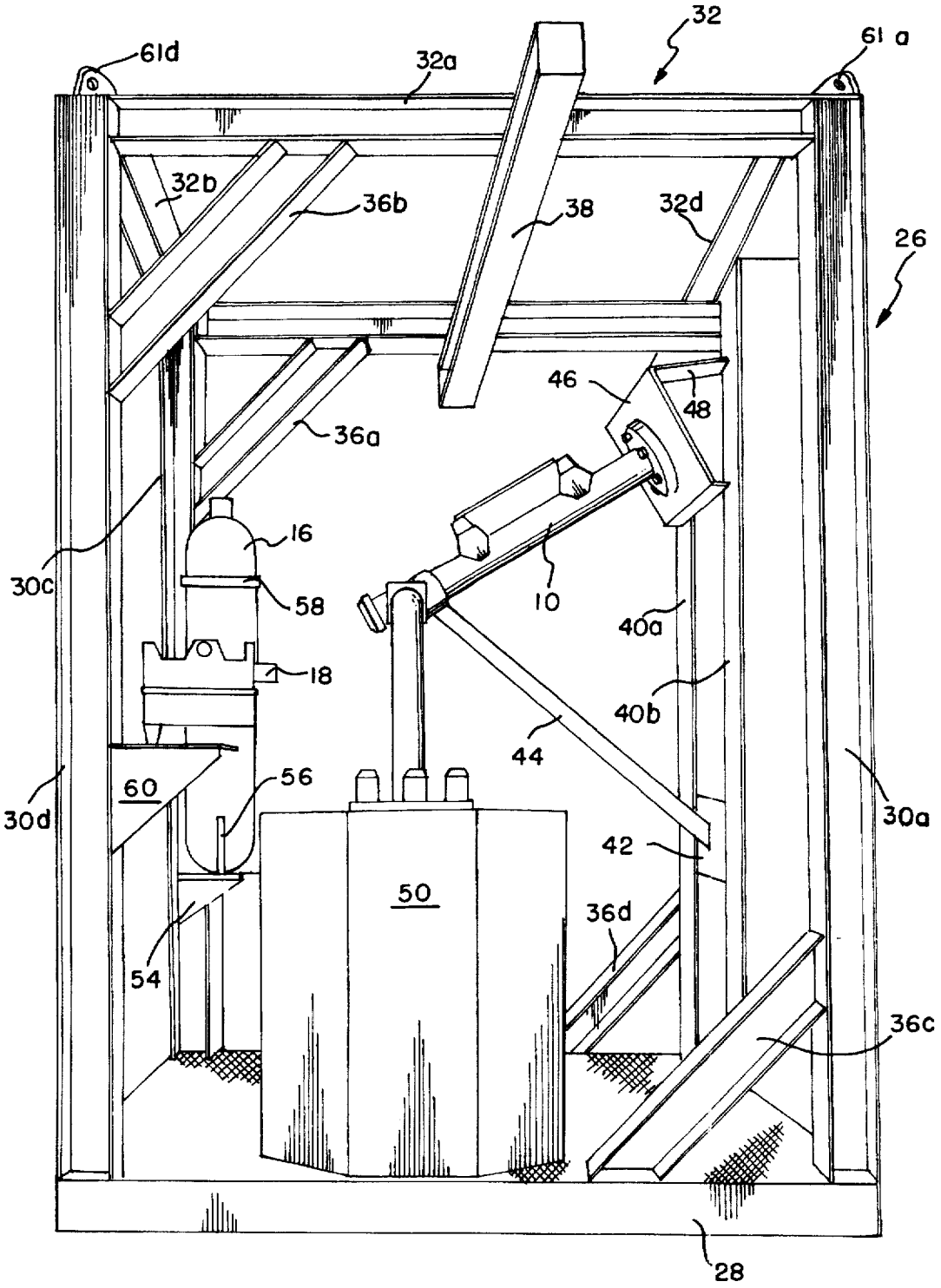
FIG. 2 is a left side perspective view of the submersible test launching platform according to the present invention.
Figure 3:
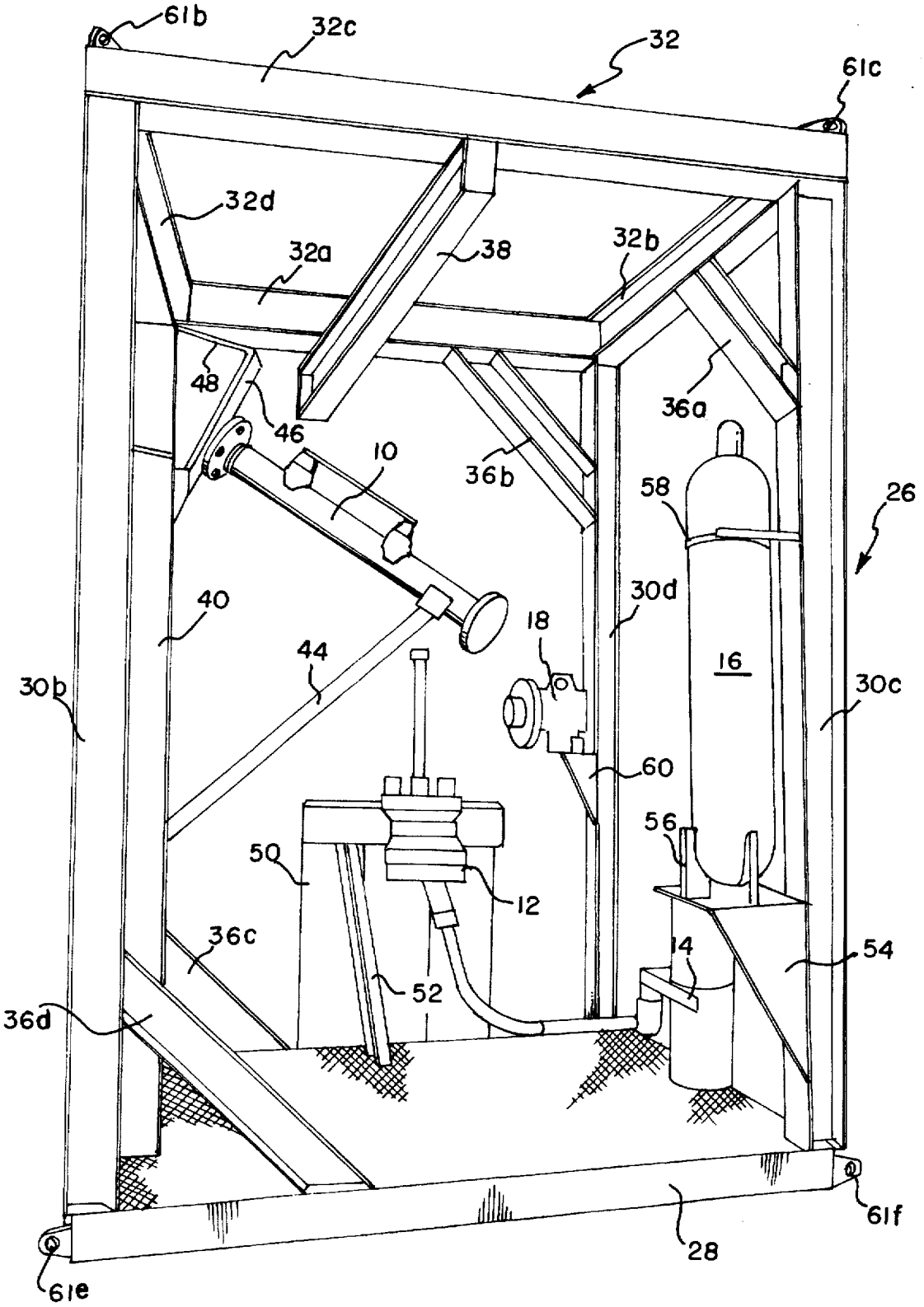
FIG. 3 is a right side perspective view of the submersible test launching platform according to the present invention.
Figure 4:
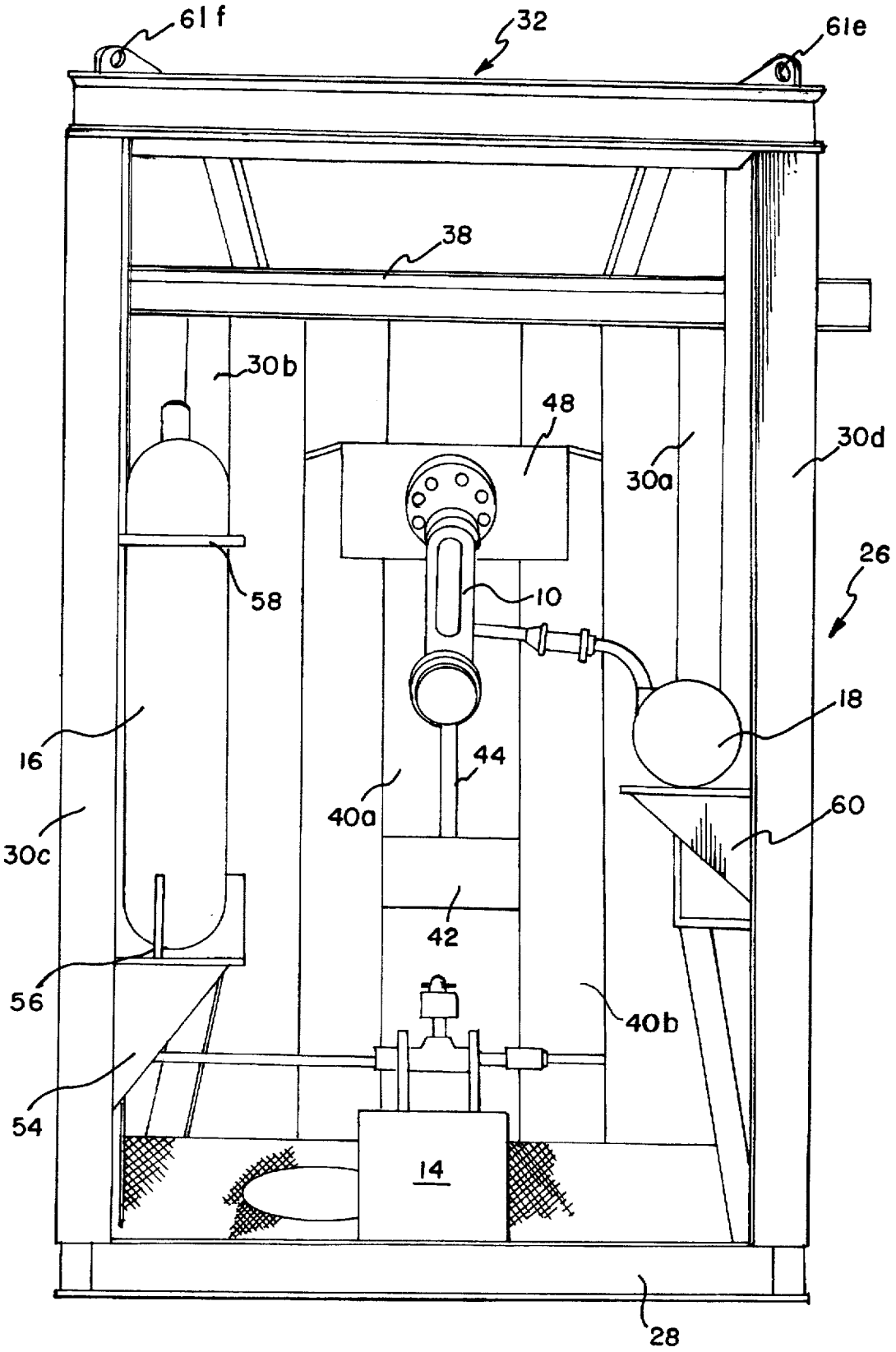
FIG. 4 is a rear view of the submersible test launching platform according to the present invention.

Referring next to FIGS. 2 through 4, the launcher is capable of being lowered as a unit within cage structure 26 to a desired depth from a pier or a surface craft. The cage structure 26 includes a base platform 28, a plurality of upstanding corner supports 30*a*, 30*b*, 30*c*, and 30*d*, and intermediate beams 32*a*–32*d* opposite base platform 28. The shape of the cage structure 26 should accommodate the components of the launcher and provide a structural integrity to the device which will withstand submersion to any necessary depth and maintain all of the components in a fixed relationship.

By way of example, and as shown in each of FIGS. 2, 3 and 4, the submersible cage structure 26 includes a rectangular base platform 28 and four upstanding corner supports 30*a*, 30*b*, 30*c* and 30*d*, one support being positioned at each corner of the base platform 28. Upper ends of the upstanding corner supports 30*a* through 30*d* are connected together by intermediate beams 32*a*, 32*b*, 32*c*, and 32*d* resulting in an overhead reinforcement 32 corresponding in shape to the base platform 28. Opposing diametrical corners of the base platform and overhead reinforcement are stiffened with angled beams 36*a*, 36*b*, 36*c*, 36*d* connecting the base platform 28 to adjacent upstanding corner supports 30*a*, 30*b*, 30*c*, and 30*d*, and connecting the overhead reinforcements 32*a*, 32*b*, 32*c*, 32*d* to adjacent upstanding corner supports. An additional strong brace beam 38 is provided on the overhead reinforcements 32*a*, 32*c*, to provide lifting capability for cage structure 26.

In order to specifically support the components within the cage structure 26, there are provided individual supports as follows. A pair of intermediate vertical beams 40*a*, 40*b* are positioned at a rear side of the cage between upstanding corner supports 30*a*, 30*b*. A brace 42 is positioned between the intermediate vertical beams 40*a*, 40*b*, and a bar 44 is connected between the brace 42 and a base end of the three-inch launcher barrel 10 as most clearly shown in FIG. 4. The opposing end of the three-inch launcher barrel 10 is connected to a plate-like brace 46 mounted with an L-shaped bracket 48 to the pair of intermediate vertical beams 40*a*, 40*b*.

Mounting of the impulse cylinder 12 is best viewed from FIG. 3 and includes a half-wall member 50 braced against the base platform 28 by a support member 52. The impulse cylinder 12 is mounted to the half-wall member 50 by any suitable means and normal fluid connections are utilized between the impulse cylinder 12 and the three-inch launcher barrel 10. The firing valve 14 is fixed directly to the base platform 28 in proximity to the impulse cylinder 12, with suitable connections therebetween.

In order to support the air flask 16, there is provided a bench member 54 mounted to one of the upstanding corner supports 30*c* as best shown in FIG. 3. The base of the air flask 16 is supported on the bench member 54 by use of prongs 56 extending upwardly therefrom in order to grip the base of the air flask 16. An upper end of the air flask 16 is anchored to the upstanding corner support 30*c* with a reinforced band 58.

The underwater junction box 18 is supported on a bench member 60 similar in construction to the bench member 54. The bench member 60, however, is mounted to an adjacent upstanding corner support 30*b* on the same side of the cage structure 26 as the bench member 54 of the air flask 16.

Cable 21 for the display panel 20 extends from the junction box 18 to the surface and to the display panel 20. The display panel 20 is operated in any suitable location on the surface of the water such as within a support craft or on a dock.

In order to raise and lower the cage structure 26 into and out of the water for testing purposes, a plurality of hoisting members 38, 61*a*, 61*b*, 61*c*, and 61*d* are provided on the periphery of the overhead reinforcement 32. At least a pair of hoisting members 61*e*, and 61*f* are provided on the periphery of the base platform 28. Appropriate chains or cables (not shown) may be threaded through these hoisting members and attached in turn to a crane for raising, lowering and generally positioning the cage structure 26.

The arrangement described is that which will enable a balanced submersion of the cage structure 26, thereby enabling optimum performance of all essential components of the test launching platform.

The deployment of a submarine for the purpose of performing functional and reliability tests on new and improved pyrotechnic devices is very expensive. The disclosed submersible three-inch device launcher provides an alternative cost effective means of conducting these tests.

The submersible three-inch device launcher therefore also provides an alternative cost effective means of conducting functional and reliability tests on new and/or improved pyrotechnic devices. The launcher is also portable and capable of being deployed from a pier or surface craft that has a 5 ton crane. The devices are launched from the surface by means of an electrical signal from the display panel 20 to the submersible firing valve.

There is currently only one way to perform functional and reliability tests on new or improved 'live' pyrotechnic three-inch devices. The only way to perform these tests is on board a U.S. Navy submarine. The deployment of a submarine for the purpose of performing functional and reliability tests on new or improved pyrotechnic devices is not cost effective. The submersible three-inch device launcher provides an alternative cost effective means of conducting these tests.

This invention has been disclosed in terms of certain embodiments. It will be apparent that many modifications can be made to the disclosed apparatus and method without departing from the invention. Therefore, it is the intent of the appended claims to cover all such variations and modifications as come within the true spirit and scope of this invention.

What is claimed is:

1. A submersible device launcher comprising:

an external cage structure;

a launcher barrel mounted to said external cage structure;

an impulse cylinder mounted to said external cage structure and in communication with said launcher barrel;

a firing valve joined to said cage structure and in communication with said impulse cylinder;

an air flask mounted on said cage structure and joined to said firing valve; and a control device electrically joined to said launcher barrel, said impulse cylinder, and said firing valve.

2. The submersible device launcher of claim 1 wherein said control device comprises:

an underwater junction box mounted on said cage structure and electrically joined to said launcher barrel, said impulse cylinder, and said firing valve.

3. The submersible device launcher of claim 1 wherein said external cage structure includes at least a base, an overhead reinforcing member and a plurality of corner posts connecting the base to the overhead reinforcing member.

4. The submersible device launcher of claim 3 wherein said launcher barrel is mounted to a side wall of said external cage structure adjacent the overhead reinforcing member and extending towards an interior of said external cage structure.

5. The submersible device launcher of claim 3 further comprising:

a half-wall mounted to and braced against the base of said external cage structure at a peripheral edge thereof.

6. The submersible device launcher of claim 3 further comprising:

a first support bench mounted to a first corner post of said external cage structure at a position above the base having prong members thereon extending upwardly from said first support bench.

7. The submersible device launcher of claim 6 wherein said air flask is seated on said first support bench and held in a stationary position thereon by said prong members fitting conformally around a base of said air flask, and said air flask being further attached to the first corner post by a band member.

8. The submersible device launcher of claim 3 further comprising:

a plurality of hoisting rings positioned externally of said external cage structure on at least one of the base and overhead reinforcing member; and a lifting cross member joined to the overhead reinforcing member of said external cage structure.

9. The submersible device launcher of claim 3 further comprising:

a pair of intermediate vertical beams positioned between a pair of adjacent corner posts;

an L-shaped bracket mounted to said pair of intermediate vertical beams in proximity to said overhead reinforcement;

a plate-like brace mounted to a leg of said L-shaped bracket; and an elongated brace fixed at one end thereof to a portion of said pair of intermediate vertical beams in proximity to the base, said launcher barrel having a first end thereof bolted to said plate-like brace and a second end thereof mounted to a distal end of said elongated brace, thereby mounting said barrel launcher at a launching angle within said external cage structure.

* * * * *